US011365651B2

(12) United States Patent
Yoon et al.

(10) Patent No.: US 11,365,651 B2
(45) Date of Patent: Jun. 21, 2022

(54) AUXILIARY POWER UNIT FOR REDUCING FLOW LOSS OF GAS

(71) Applicant: HANWHA AEROSPACE CO., LTD., Changwon-si (KR)

(72) Inventors: Yong Sang Yoon, Changwon-si (KR); Hee Yoon Chung, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 406 days.

(21) Appl. No.: 16/540,420

(22) Filed: Aug. 14, 2019

(65) Prior Publication Data

US 2020/0182092 A1 Jun. 11, 2020

(30) Foreign Application Priority Data

Dec. 10, 2018 (KR) ..... 10-2018-0158546

(51) Int. Cl.
*F01D 25/30* (2006.01)

(52) U.S. Cl.
CPC ..... *F01D 25/305* (2013.01); *F05D 2240/12* (2013.01); *F05D 2250/70* (2013.01)

(58) Field of Classification Search
None
See application file for complete search history.

(56) References Cited

U.S. PATENT DOCUMENTS 6,752,133 B2 6/2004 Arnell
6,896,475 B2 * 5/2005 Graziosi ..... F01D 25/305 415/1
8,495,992 B2 7/2013 Roth
8,511,066 B2 8/2013 Harris et al.
8,556,027 B2 * 10/2013 Francisco ..... F02K 1/46 181/213
9,145,214 B2 * 9/2015 Payangapadan ..... B64D 33/02
2018/0058373 A1 3/2018 Gaw et al.
2018/0252142 A1 9/2018 Kubota et al.

FOREIGN PATENT DOCUMENTS

JP 6223559 B2 11/2017
JP 2018-100669 A 6/2018
KR 10-1998-048214 A 9/1998
KR 10-1685853 B1 12/2016
KR 10-1865119 B1 6/2018
KR 10-2018-0101193 A 9/2018

* cited by examiner

*Primary Examiner* — Jason H Duger
(74) *Attorney, Agent, or Firm* — Sughrue Mion, PLLC

(57) ABSTRACT

An auxiliary power unit that can reduce a flow loss of gas includes: a compressor, a combustion chamber, a turbine, a turbine outlet, and a bypass duct, wherein the turbine outlet comprises an exhaust diffuser and a guide portion, wherein the bypass duct connects the compressor with the guide portion, wherein the guide portion is a channel for an air or gas and is extended radially from an outer circumferential surface of the exhaust diffuser and communicates with an inside of the exhaust diffuser via an opening, and wherein the exhaust diffuser has a first portion adjacent to a front end of the opening and a second portion adjacent to a rear end of the opening, and a radius of the second portion is larger than a radius of the first portion so that there is formed a step difference between the first portion and the second portion.

9 Claims, 5 Drawing Sheets

AUXILIARY POWER UNIT FOR REDUCING FLOW LOSS OF GAS

CROSS-REFERENCE TO THE RELATED APPLICATION

This application claims priority from Korean Patent Application 10-2018-0158546 filed on Dec. 10, 2018 in the Korean Intellectual Property Office, the disclosure of which is incorporated herein by reference in its entirety.

BACKGROUND

1. Field

Apparatuses and methods consistent with the exemplary embodiments of the inventive concept relate to an auxiliary power unit, and more specifically to an auxiliary power unit for reducing a flow loss generated from collision between a bypass flow and a main flow by increasing the radius of an exhaust diffuser before and after the point where the bypass flow joins the main flow.

2. Description of the Related Art

A main engine of an aircraft is too large to simply start up with a battery, unlike a car engine. Previously, a special vehicle called a ground power unit (GPU) was connected to start up the main engine of an aircraft. Recently, a small engine called an auxiliary power unit (APU) is mounted in an aircraft to supply a high-pressure air required to start up the main engine of an aircraft.

The main engine, which is a jet engine, may be started up as follows: When a compressed air rotates a pneumatic starter, and a compressor connected to the pneumatic starter rotates together with the pneumatic starter to achieve a rotational speed above a predetermined value, the compressed air is supplied into a combustion chamber of the main engine. At this time, when a fuel is injected into the combustion chamber and then ignited, the compressed air is burned. The burned high-temperature, high-pressure air is sprayed backward to rotate a turbine, so that the compressor rotates, which is installed in front of the combustion chamber, on a rotational shaft where the turbine is installed. When the rotational speed of the compressor gradually increases so that the air introduced into the combustion chamber is completely compressed, the air and the fuel are spontaneously burned by continuously injecting the fuel without additional ignition in the combustion chamber. At this time, a discharged gas rotates the turbine and the compressor, and then the start-up process terminates.

The auxiliary power unit provides the compressed air for rotating the pneumatic starter at the initial stage of the main engine start-up process described above. The auxiliary power unit performs several functions in addition to starting up the main engine. Firstly, the auxiliary power unit generates electrical power to be supplied to the aircraft. When an aircraft is moored at an airport, the main engine cannot be started because of environmental pollution issues, etc., and thus, the auxiliary power unit supplies the power necessary for the operation of the aircraft electronic equipment. Secondly, the auxiliary power unit controls an environmental system to provide bleed air such as air conditioning air required in a cabin of the aircraft. Thirdly, the auxiliary power unit supports the main engine. In case of emergency, the auxiliary power unit is driven to provide additional thrust even if the main engine is running.

The auxiliary power unit also generates energy through a compressor, a combustion chamber and a turbine to perform the above functions, similar to the main engine. In doing so, it is necessary to cause air to bypass them before the combustion of the air for various purposes. Such air flow is referred to as a bypass flow. In contrast, a flow of air that produces energy through a compressor, a combustion chamber and a turbine is referred to as a main flow. The bypass flow joins the main flow on an outlet side of the turbine to be discharged to an exhaust duct.

In an related art turbine, there is no change in the radius at an outlet side of the turbine before and after a point where the bypass flow joins the main flow. As a result, the bypass flow and the main flow collide with each other to generate turbulence, which lowers an exhaust efficiency of the turbine, thereby deteriorating energy efficiency of the auxiliary power unit.

SUMMARY

Various aspects of the inventive concept provide an auxiliary power unit for reducing a flow loss by reducing the occurrence of turbulence generated by the collision between a bypass flow and a main flow at a turbine outlet.

It should be noted that the objects of the inventive concept are not limited to the above-mentioned objects, and other objects will be apparent to those skilled in the art from the following descriptions.

According to an aspect of exemplary embodiments, there is provided an auxiliary power unit for reducing a flow loss of gas, the auxiliary power unit comprising a compressor, a combustion chamber, a turbine, a turbine outlet and a bypass duct, wherein the turbine outlet comprises an exhaust diffuser and a guide portion, wherein the bypass duct connects the compressor with the guide portion, wherein the guide portion is a channel for an air or gas, and is extended radially from an outer circumferential surface of the exhaust diffuser and communicates with an inside of the exhaust diffuser via an opening, and wherein the exhaust diffuser has a first portion that is adjacent to a front end of the opening and a second portion that is adjacent to a rear end of the opening, and a radius of the second portion is larger than a radius of the first portion so that there is formed a step difference between the first portion and the second portion.

The guide portion may be formed in an annular shape surrounding at least a part of the outer circumferential surface of the exhaust diffuser around 360 degrees.

The opening may be formed along an outer diameter of the exhaust diffuser, between the guide portion and the exhaust diffuser.

The guide portion may be formed to be inclined from a position of the opening toward an inlet of the exhaust diffuser.

The radius of the exhaust diffuser on the diffuser inlet side may be equal to or greater than 0.9 and less than 1 when the radius on the diffuser outlet side is 1.

Other particulars of the inventive concept will be described in the detailed description with reference to the accompanying drawings.

According to exemplary embodiments, at least following effects can be achieved. It may be possible to reduce the occurrence of turbulence generated due to the collision between the bypass flow and the main flow by way of improving the shape of the turbine outlet, thereby increasing an exhaust efficiency and improving a turbine output and an energy efficiency.

It should be noted that effects of the inventive concept are not limited to those described above and other effects will be apparent to those skilled in the art from the following descriptions.

DETAILED DESCRIPTION OF THE EXEMPLARY EMBODIMENTS

Figure 1:
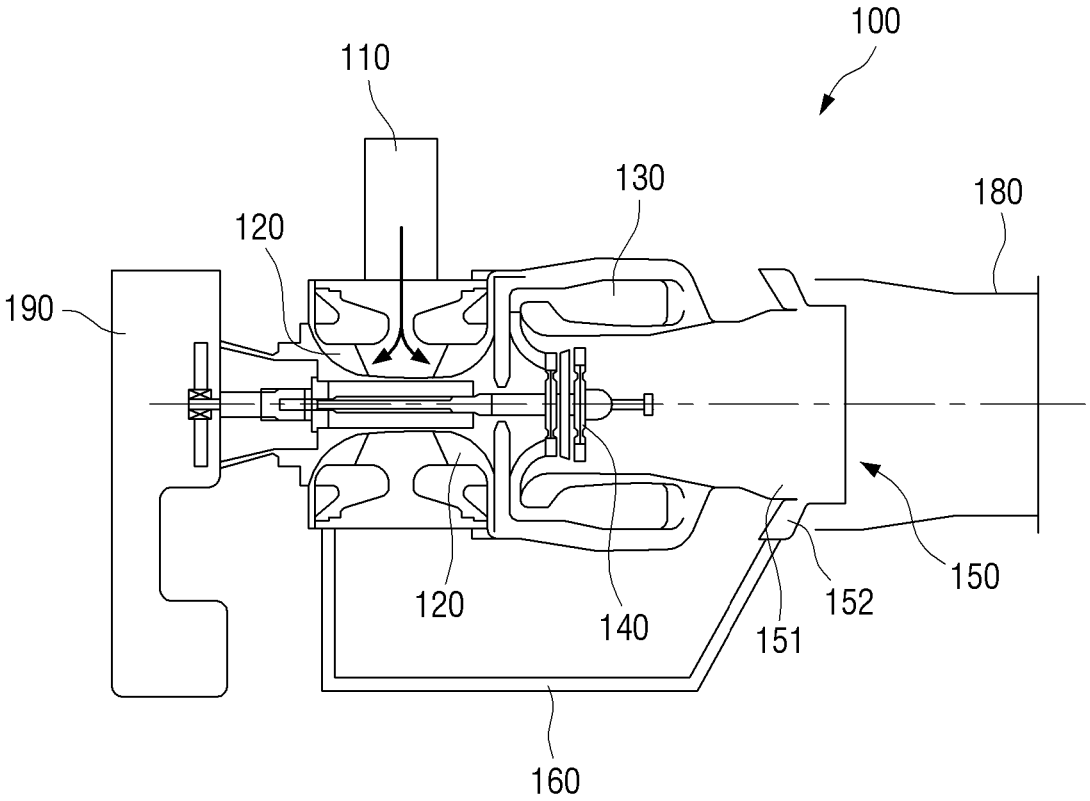
FIG. 1 is a cross-sectional view of an auxiliary power unit that reduces a flow loss of a gas according to an exemplary embodiment.

Advantages and features of the inventive concept and methods to achieve them will become apparent from the descriptions of exemplary embodiments herein with reference to the accompanying drawings. However, the inventive concept is not limited to exemplary embodiments disclosed herein but may be implemented in various different ways. The exemplary embodiments are provided for making the disclosure of the inventive concept thorough and for fully conveying the scope of the inventive concept to those skilled in the art. It is to be noted that the scope of the inventive concept is defined only by the claims. Like reference numerals denote like elements throughout the descriptions.

Unless otherwise defined, all terms (including technical and scientific terms) used herein have the same meaning as commonly understood by one of ordinary skill in the art to which this inventive concept pertains. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

Terms used herein are for illustrating the exemplary embodiments rather than limiting the inventive concept. As used herein, the singular forms are intended to include plural forms as well, unless the context clearly indicates otherwise. Throughout this specification, the word "comprise" and variations such as "comprises" or "comprising," will be understood to imply the inclusion of stated elements but not the exclusion of any other elements.

An auxiliary power unit refers to an apparatus which starts up a main engine or supplies auxiliary electrical power necessary for an aircraft, and also provides necessary air in a cabin of the aircraft. The auxiliary power unit described herein may encompass ones employed in an automobile, a ship, a spacecraft, etc. as well as an aircraft.

Figure 2:
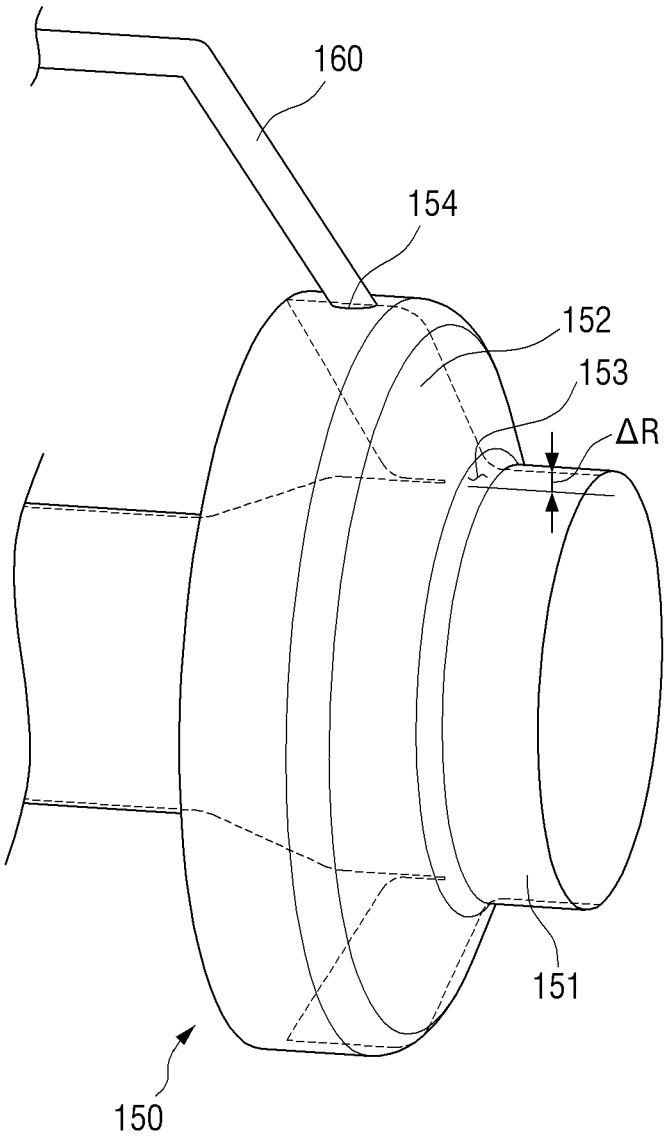
FIG. 2 is an enlarged, perspective view of a turbine outlet of an auxiliary power unit according to an exemplary embodiment.

FIG. 1 is a cross-sectional view of an auxiliary power unit that reduces a flow loss of a gas according to an exemplary embodiment. FIG. 2 is an enlarged, perspective view of a turbine outlet of the auxiliary power unit according to an exemplary embodiment.

Referring to FIGS. 1 and 2, an auxiliary power unit 100 comprises a compressor 120, a combustion chamber 130, a turbine 140, a turbine outlet 150, and a bypass duct 160. The turbine outlet comprises an exhaust diffuser 151 and a guide portion 152. The bypass duct 160 connects the compressor 120 with the guide portion 152. The guide portion 152 is a channel for air flow, and is extended radially from an outer circumferential surface of the exhaust diffuser 151 and communicates with an inside of the exhaust diffuser 151 via an opening 153. The exhaust diffuser 151 has a first portion 153*a* that is adjacent to a front end of the opening 153 and a second portion 153*b* that is adjacent to a rear end of the opening 153, and a radius of the second portion 153*b* is larger than a radius of the first portion 153*a* so that there is formed a step difference ΔR between the first portion 153*a* and the second portion 153*b* (see FIG. 4).

The auxiliary power unit 100 according to the exemplary embodiment is started by a battery mounted on an aircraft. When the battery causes a motor housed in a gear box 190 to rotate, gears connected to the motor transmit torque to a rotating shaft, thereby starting the driving of the compressor 120 installed on the rotating shaft.

The compressor 120 converts air supplied from an inlet 110 into low-speed, high-pressure air. The compressor 120 has two main functions. Firstly, it supplies air required for combustion into the combustion chamber 130, and secondly, it supplies bleed air into the cabin. The bleed air refers to high-temperature, high-pressure air that is supplied into the aircraft to adjust temperature and pressure. The bleed air is drawn at various stages of the compressor 120 and used for the foregoing purposes. FIG. 1 shows two separate compressors 120, one for generating compressed air to be supplied to the combustion chamber 130 and the other for generating compressed air to be consumed in the cabin, which are connected to each other through a single rotating shaft. It is, however, to be understood that a single compressor may be used to achieve the same purposes.

A fuel is injected into the combustion chamber 130 where the high-pressure air is introduced from the compressor 120 and the fuel is burned. The fuel is continuously injected from a fuel injection nozzle located in the front of the combustion chamber 130, so that the fuel is mixed with the high-pressure air, and a spark plug ignites the fuel to burn. Once the compressor 120 provides sufficient compressed air after the initial driving of the auxiliary power unit 100, the combustion process can proceed only by injecting the fuel without driving the spark plug.

As the high-temperature and high-pressure combustion gas in the combustion chamber 130 expands, blades of the turbine 140 are rotated, such that the thermal energy is converted into kinetic energy. The kinetic energy obtained from the turbine 140 is used to drive the compressor 120. An exhaust gas flows into an exhaust duct 180 through the turbine outlet 150 and is discharged to the outside after necessary post-treatment in the exhaust duct 180.

The turbine outlet 150 may include the exhaust diffuser 151 that is a conduit for flowing the exhaust gas, and a guide portion 152 that is extended from one surface of the exhaust diffuser 151 to guide a bypass flow into the exhaust diffuser 151.

The exhaust diffuser 151 is disposed at the downstream of the turbine 140 and serves to guide the exhaust gas having passed through the turbine 140 to the exhaust duct 180. The exhaust diffuser 151 has a shape of which a cross-sectional area becomes larger in a direction toward the exhaust duct 180 from the turbine 140, thereby reducing speed of the exhaust gas. The radius of the exhaust diffuser 151 is increased immediately before and after the guide portion 152 to form a step difference ΔR, thereby reducing a flow loss generated by collision between the bypass flow and the main flow. This will be described in more detail later.

The exhaust gas that has passed through the turbine 140 is discharged to the outside through the exhaust duct 180. Since the exhaust gas is high in pressure and high in temperature, it may result in large noise when it is discharged as it is, and the surroundings may become dangerous due to the heat contained in the gas. In addition, the exhaust gas contains air pollutants, and thus it is necessary to purify it. The exhaust duct 180 may include an exhaust gas purifier and an apparatus for reducing exhaust noise and heat.

As described above, air introduced into the inlet 110 is discharged as the exhaust gas to the outside from the exhaust duct 180 through the compressor 120, the combustion chamber 130 and the turbine 140. Such gas flow is referred to as the main flow.

There is a bypass flow in contrast to the main flow of the gas. The bypass flow refers to a flow in which the high pressure air compressed by the compressor 120 bypasses the combustion chamber 130 and the turbine 140, and is discharged directly via the outlet of the turbine 140.

As described above, the auxiliary power unit 100 serves to provide necessary power to the aircraft before the main engine is driven and/or provide air necessary in the cabin. In this regard, since the complete combustion of the fuel in the combustion chamber 130 cannot occur before an impeller of the compressor 120 reaches a sufficient rotational speed in the initial stage of driving the auxiliary power unit 100, it is necessary to discharge the residual compressed air to the outlet of the turbine 140 via the bypass duct until the compressor 120 provides sufficient air to drive the combustion chamber 130. In addition, regarding supplying air, excessive air exceeding a certain amount of air required for various purposes such as air-conditioning and heating in the cabin should be discharged directly without being supplied to the cabin. Such flow of unnecessary compressed air that is directly discharged via a bypass channel is referred to as the bypass flow.

The bypass duct 160 provides the bypass channel through which unnecessary compressed air flows. The bypass duct 160 may be a tube connecting the compressor 120 with the turbine outlet 150. An inlet of the bypass duct 160 is connected to the compressor 120, and an outlet of the bypass duct 160 is connected to the turbine outlet 150, so that unnecessary compressed air may be discharged through the turbine outlet 150 to the exhaust duct 180.

Specifically, the outlet of the bypass duct 160 may be connected to the guide portion 152 of the turbine outlet 150. The guide portion 152 serves to guide the bypass flow to reduce energy loss due to flow resistance when the bypass flow joins the main flow inside the exhaust diffuser 151. The outlet of the bypass duct 160 may be formed at any point on the surface of the guide portion 152. It should be noted that the guide portion 152 can guide the bypass flow most efficiently when the outlet of the bypass duct 160 is formed farthest from the opening 153 of the guide portion 152 connected to the exhaust diffuser 151.

All the surfaces of the guide portion 152 are closed except for an opening 154 connected to the outlet of the bypass duct 160 and the opening 153 connected to the exhaust diffuser 151. Accordingly, the air introduced through the bypass duct 160 is entirely discharged to the exhaust diffuser 151 through the guide portion 152.

According to an exemplary embodiment, the guide portion 152 may be formed as an annular tube that surrounds a portion of the outer circumferential surface of the exhaust diffuser 151 around 360 degrees, and may be extended from the exhaust diffuser 151. The guide portion 152 is extended from the surface of the exhaust diffuser 151 while forming the opening 153. The bypass flow may be introduced into the exhaust diffuser 151 through the opening 153. The opening 153 may be formed along a connection portion between the guide portion 152 and the exhaust diffuser 151. Particularly, when the guide portion 152 is formed to surround the outer circumferential surface of the exhaust diffuser 151 around 360 degrees, the opening 153 may be formed in a circular shape formed by rotating 360 degrees along the outer diameter at one point of the outer circumferential surface of the exhaust diffuser 151. Due to this structure of the opening 153, the bypass flow can be evenly distributed and introduced along the inner circumferential surface of the exhaust diffuser 151. The air introduced through the guide portion 152 joins the gas discharged through the turbine 140 inside the exhaust diffuser 151.

According to an exemplary embodiment, the guide portion 152 may be extended radially from the surface of the exhaust diffuser 151, and may be inclined toward the inlet of the exhaust diffuser 151, i.e., toward the turbine 140. When the guide portion 152 is formed to be inclined toward the turbine 140, as compared with the guide portion 152 perpendicular to the surface of the exhaust diffuser 151, the inflow angle of the bypass flow can be made closer to the horizontal at the point where the bypass flow joins the diffuser. As a result, the bypass flow can be more easily guided to the step difference ΔR of the exhaust diffuser 151 formed on the rear end of the guide portion 152, as described later.

Hereinafter, the influence of the exhaust diffuser 151 on the flow loss depending on whether there is a difference in the radius of the exhaust diffuser 151 immediately before and after the outlet of the guide portion 152 or not will be described. As used herein, the front side refers to the side closer to the inlet of the exhaust diffuser 151 (the side closer to the turbine 140), while the rear side refers to the side closer to the outlet of the exhaust diffuser 151 (the side closer to the exhaust duct 180). The radius of the exhaust diffuser 151 immediately before the outlet of the guide portion 152 is referred to as the radius R1 at the diffuser inlet side, while the radius of the exhaust diffuser 151 immediately after the outlet of the guide portion 152 is referred to as the radius R2 at the diffuser outlet side.

Figure 3:
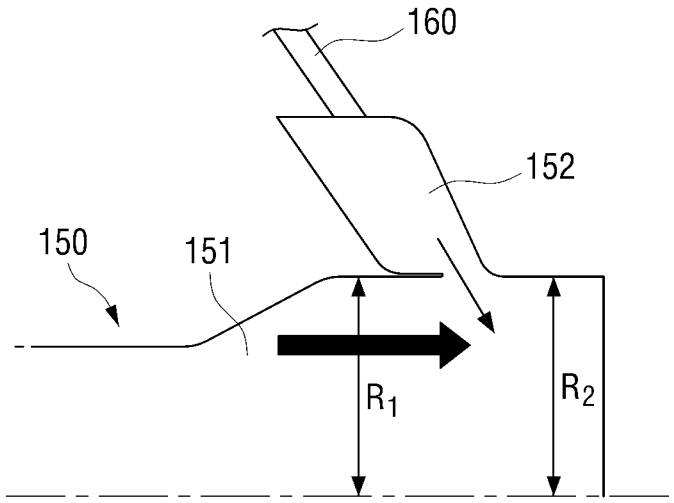
FIGS. 3 and 4 are views for comparing a related art turbine outlet with a turbine outlet according to an exemplary embodiment.
Figure 4:
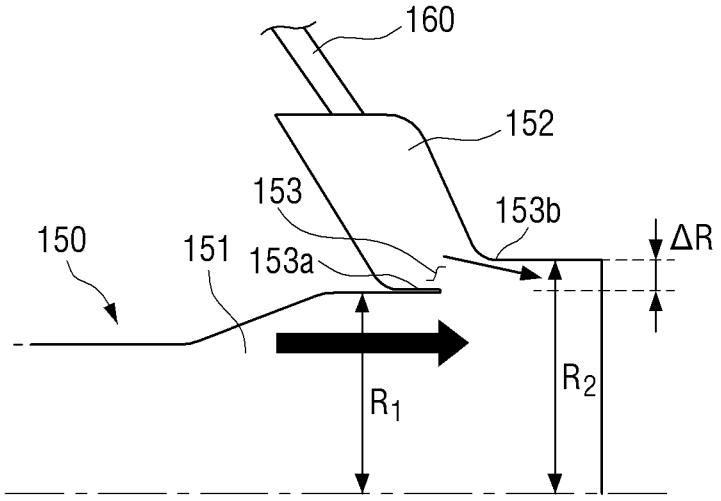

FIG. 3 is a cross-sectional view of a turbine outlet of a related art auxiliary power unit. FIG. 4 is a cross-sectional view of a turbine outlet of an auxiliary power unit according to an exemplary embodiment.

Referring to FIG. 3, in the related art exhaust diffuser 151, the radius R1 at the diffuser inlet side is equal to the radius R2 at the diffuser outlet side. Therefore, turbulence may occur inside the exhaust diffuser 151 as the bypass flow flowing into the exhaust diffuser 151 through the guide portion 152 collides with the main flow passing through the turbine 140. When the turbulence occurs, an exhaust efficiency of the turbine 140 is lowered. As a result, the power of the turbine 140 decreases and more fuel is consumed. An energy loss due to the friction of the fluids is referred to as a flow loss.

In contrast, according to the exemplary embodiment shown in FIG. 4, the radius R2 at the diffuser outlet side of the exhaust diffuser 151 is larger than the radius R1 at the diffuser inlet side. The difference between the diffuser outlet side radius R2 and the diffuser inlet side radius R1 is referred to as the step difference ΔR. By forming the step difference ΔR, the bypass flow and the main flow can become closer to being parallel.

Specifically, the step difference ΔR serves as a clearance space for guiding the bypass flow of the air, so that the possibility of collision between the main flow and the bypass flow can be reduced. The high-temperature and high-speed main flow already flows from above the central axis of the exhaust diffuser 151 to the height of the radius R1 on the diffuser inlet side. At this time, the bypass flow introduced into the exhaust diffuser 151 through the guide portion 152 can be guided toward the step difference ΔR formed at the rear of the outlet of the guide portion 152. Therefore, the main flow and the bypass flow joining in the exhaust diffuser 151 form a flow at an angle close to parallel, and as a result, the probability of occurrence of turbulence can be reduced. In this manner, by forming the shape of the exhaust diffuser 151 such that the radius of the exhaust diffuser 151 increases immediately before and after the guide portion 152, the flow loss can be reduced.

Figure 5:
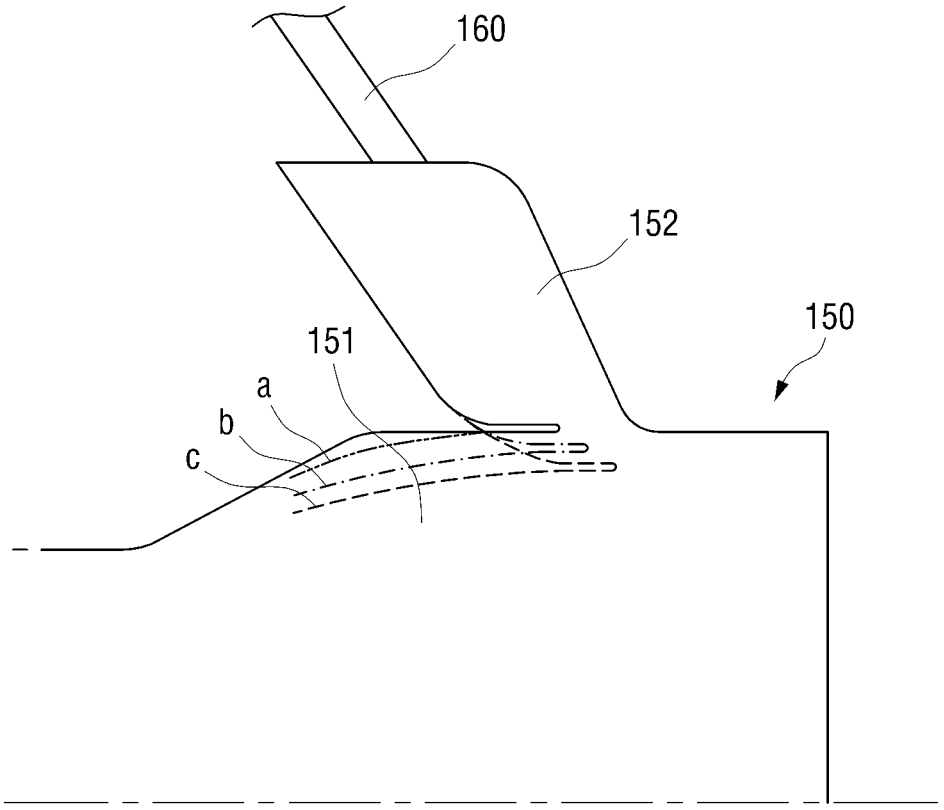
FIG. 5 is a view showing turbine outlet shapes of an auxiliary power unit according to various exemplary embodiments.
Figure 6:
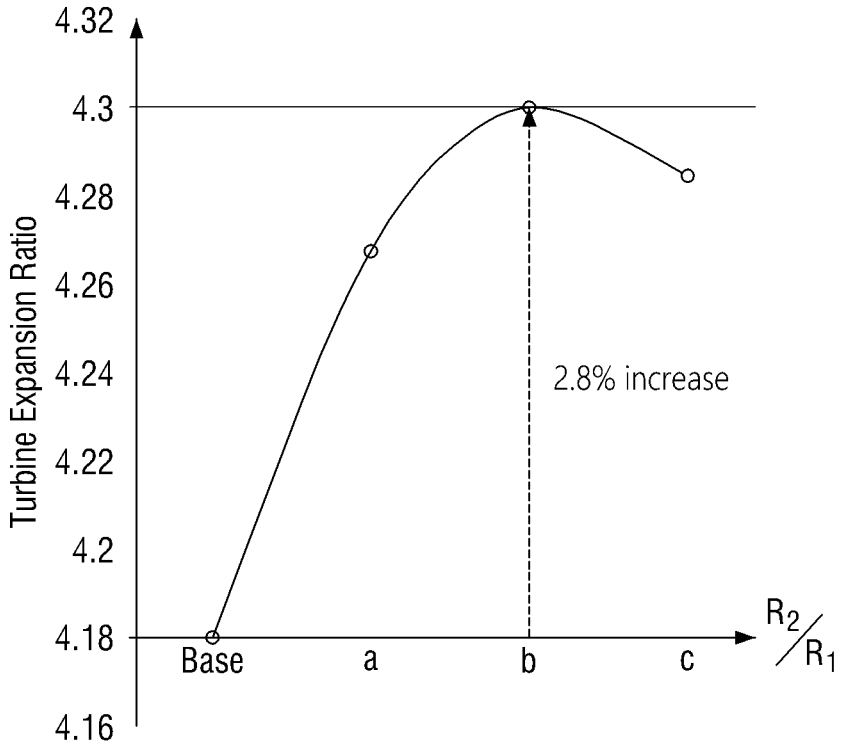
FIG. 6 is a graph comparing turbine powers according to the exemplary embodiments of FIG. 5.

FIG. 5 is a view showing turbine outlet shapes of an auxiliary power unit according to various exemplary embodiments. FIG. 6 is a graph comparing turbine powers according to the exemplary embodiments of FIG. 5.

Referring to FIGS. 5 and 6, the radius of the exhaust diffuser 151 of the auxiliary power unit 100 according to the exemplary embodiments is gradually increased from the diffuser inlet toward the guide portion 152. Due to this structure, the speed of the exhaust gas discharged from the turbine 140 can be reduced. If the radius of the exhaust diffuser 151 increases sharply and accordingly the curvature of the cross section at the inlet of the exhaust diffuser 151 becomes large, the flow loss can be increased due to flow separation between the main flow and the inner circumferential surface of the exhaust diffuser 151.

The flow separation refers to a phenomenon in which kinetic energy of a fluid fails to overcome an adverse pressure gradient at a boundary layer between the fluid and a friction surface, which accordingly causes the fluid flow backward to be separated from the friction surface. In the vicinity of a point where the flow separation occurs, backward velocity is generated by the adverse pressure gradient, resulting in an eddy flow, i.e., a wake. If such flow separation and wake occur, an exhaust efficiency inside the exhaust diffuser 151 is reduced, and further, an energy efficiency of the turbine 140 is reduced.

Therefore, in order to reduce the flow loss, the curvature of the exhaust diffuser 151 at the inlet side should be gentle. However, if the curvature is to be too gentle, the radius of the exhaust diffuser 151 that should be increased is reduced since the length of the exhaust diffuser 151 is limited. If the radius of the exhaust diffuser 151 is reduced, it is not possible to achieve the design objective of an exhaust diffuser which is able to reduce the speed of an exhaust gas. Therefore, a tradeoff should be made between the curvature of the exhaust diffuser 151 at the inlet side and the radius.

FIGS. 5 and 6 show experimental examples for comparing the efficiencies of the turbine 140 while varying the curvature of the exhaust diffuser 151 at the inlet side and the radius. For Case Base, the radius R1 at the diffuser inlet side is 1 when the radius R1 at the diffuser outlet side is 1, and the radius is rapidly increased so that the diffuser inlet side has a trapezoidal cross section. For Case a, the radii R1 and R2 are equal to those of Case Base, but the diffuser inlet side has a trapezoidal cross section with a rounded corner so that the radius of the exhaust diffuser 151 is more gently increased. For Case c, the radius R1 on the diffuser inlet side is 0.9 when the radius R1 on the diffuser outlet side is 1, and the cross section at the diffuser inlet side has a gentle curve. For Case b, the radius R1 at the diffuser inlet side is a value between 1 and 0.9 when the radius R2 at the diffuser outlet side is 1, and the cross section at the diffuser inlet side has a curvature greater than that of Case a and smaller than that of Case c. The cross-sectional areas of the outlet of the guide portion 152 where the guide portion 152 is connected to the exhaust diffuser 151 are equal for all of the cases, so that the same amount of bypass flow per time flows into the exhaust diffuser 151.

A turbine expansion ratio of the turbine 140 was measured in all cases. As a result, Case b showed the highest turbine expansion ratio, which means the highest efficiency of the turbine 140. The efficiently of Case b was increased by 2.8% compared to the efficiency of Case Base.

It can be seen from the results of comparing Cases Base, Case a and Case b that the efficiency of the turbine 140 increases as the radius of curvature of the inlet of the exhaust diffuser increases, and the difference between the radius at the diffuser inlet side R1 and the radius at the diffuser outlet side R2, i.e., the step difference ΔR increases. This may be because the flow loss due to the flow separation is reduced as the radius of curvature of the inlet of the exhaust diffuser 151 becomes larger, and the flow loss due to the collision between the bypass flow and the main flow decreases as the step difference ΔR becomes larger.

However, when Case b and Case c are compared, the efficiency of the turbine 140 decreases for Case c where the radius of curvature at the diffuser inlet side is larger and the step difference ΔR is larger. This may be because although the flow loss due to the flow separation is reduced as the curved surface at the inlet of the diffuser is formed gently in Case c, the radius R1 at the diffuser inlet side is too small, and thus the speed of the main flow is not greatly reduced, such that the flow loss due to the collision between the main flow and the bypass flow is lager.

As can be seen from the above, in order to prevent the reduction of the flow loss and increase the efficiency of the turbine 140, it is necessary to experimentally determine an appropriate ratio between the radius R1 at the diffuser inlet side and the radius R2 at the diffuser outlet side. From the results of comparing the various exemplary embodiments, it is found that the efficiency of the turbine 140 becomes the maximum value when the radius R2 at the diffuser outlet side is 1 and the radius R1 at the diffuser inlet side is in the range of 0.9 to 1.

It will be evident to those skilled in the art that various modifications and changes may be made in the exemplary embodiments without departing from the technical idea or the gist of the inventive concept. Therefore, it should be understood that the above-mentioned embodiments are not limiting but illustrative in all aspects. It should be understood that the drawings and the detailed description are not intended to limit the inventive concept to the particular forms disclosed herein, but on the contrary, the intention is to cover all modifications, equivalents, and alternatives falling within the spirit and scope of the inventive concept as defined by the appended claims.

What is claimed is:

1. An auxiliary power unit comprising a compressor, a combustion chamber, a turbine, a turbine outlet, and a bypass duct, wherein the turbine outlet comprises an exhaust diffuser and a guide portion, wherein the bypass duct connects the compressor with the guide portion, wherein the guide portion is a channel for an air or gas, and is extended radially from an outer circumferential surface of the exhaust diffuser and communicates with an inside of the exhaust diffuser via an opening, wherein the exhaust diffuser has a first portion that is adjacent to a front end of the opening and a second portion that is adjacent to a rear end of the opening, and a radius of the second portion is larger than a radius of the first portion so that there is formed a step difference between the first portion and the second portion, wherein the first portion is positioned immediately before the guide portion, and the second portion is positioned immediately after the guide portion, wherein the second portion of the exhaust diffuser extends parallel to an axial direction of the exhaust diffuser, and wherein a third portion of the exhaust diffuser, immediately before the first portion of the exhaust diffuser, has a curved surface that is connected to the first portion.

2. The auxiliary power unit of claim 1, wherein the guide portion is formed in an annular shape surrounding at least a part of the outer circumferential surface of the exhaust diffuser around 360 degrees.

3. The auxiliary power unit of claim 2, wherein the opening is formed along an outer diameter of the exhaust diffuser, between the guide portion and the exhaust diffuser.

4. The auxiliary power unit of claim 1, wherein the guide portion is formed to be inclined from a position of the opening toward an inlet of the exhaust diffuser.

5. The auxiliary power unit of claim 1, wherein a ratio of a radius of the exhaust diffuser at an inlet of the exhaust diffuser to the radius of the exhaust diffuser at an outlet of the exhaust diffuser is equal to or greater than 0.9 and less than 1.

6. An auxiliary power unit comprising a compressor, a combustion chamber, a turbine, a turbine outlet, and a bypass duct, wherein the turbine outlet comprises an exhaust diffuser and a guide portion that is connected to the exhaust diffuser, wherein the exhaust diffuser is configured to be connected to an exhaust duct so that an exhaust gas output from the turbine is discharged through the exhaust diffuser and the exhaust duct, wherein the exhaust diffuser has a shape of which a cross-sectional area becomes larger in a direction from the turbine to the exhaust duct, wherein the bypass duct is connected to the guide portion and is configured to discharge air or gas in the compressor to the exhaust diffuser via the guide portion through an opening formed in the guide portion that communicates with the bypass duct, wherein a radius of the exhaust diffuser is increased from immediately before to immediately after the guide portion to form a step difference, wherein the exhaust diffuser has a first portion that is adjacent to a front end of the opening and a second portion that is adjacent to a rear end of the opening, and a radius of the second portion is larger than a radius of the first portion, wherein the first portion is positioned immediately before the guide portion, and the second portion is positioned immediately after the guide portion, wherein the second portion of the exhaust diffuser extends parallel to an axial direction of the exhaust diffuser, and wherein a third portion of the exhaust diffuser, immediately before the first portion of the exhaust diffuser, has a curved surface that is connected to the first portion.

7. The auxiliary power unit of claim 6, wherein the guide portion is extended from the exhaust diffuser and surrounds a portion of an outer circumferential surface of the exhaust diffuser around 360 degrees, and wherein the opening of the guide portion is formed in a circular shape along an outer diameter at one point of the outer circumferential surface of the exhaust diffuser.

8. The auxiliary power unit of claim 7, wherein a ratio of the radius of the exhaust diffuser immediately before the guide portion to immediately after the guide portion ranges between 0.9 and 1.

9. The auxiliary power unit of claim 6, wherein the guide portion is formed to be inclined so that a flow of the discharged air or gas in the guide portion is injected into the exhaust diffuser in an inclined direction.

* * * * *